US007780237B2

(12) United States Patent
Chen et al.

(10) Patent No.: US 7,780,237 B2
(45) Date of Patent: Aug. 24, 2010

(54) HEADREST FOR CHILD SEAT

(75) Inventors: Shun-Min Chen, Taipei (TW); Jun-Xu Jin, Taipei (TW)

(73) Assignee: Wonderland Nursery Goods Co., Ltd., Taipei (TW)

( * ) Notice: Subject to any disclaimer, the term of this patent is extended or adjusted under 35 U.S.C. 154(b) by 0 days.

(21) Appl. No.: 11/987,200

(22) Filed: Nov. 28, 2007

(65) Prior Publication Data

US 2008/0315648 A1 Dec. 25, 2008

(30) Foreign Application Priority Data

Jun. 20, 2007 (CN) ..... 2007 2 0152031 U

(51) Int. Cl.
*A47D 15/00* (2006.01)

(52) U.S. Cl. ..... 297/397; 297/410

(58) Field of Classification Search ..... 297/250.1, 297/353, 397, 408, 410, 399, 400, 230.14
See application file for complete search history.

(56) References Cited

U.S. PATENT DOCUMENTS

| | | | | | |
|---|---|---|---|---|---|
| 394,271 | A | * | 12/1888 | Hooven | 297/397 |
| 673,617 | A | * | 5/1901 | Deaner | 297/399 |
| 711,259 | A | * | 10/1902 | Pickering | 297/399 |
| 792,669 | A | * | 6/1905 | Schaff | 297/399 |
| 1,357,826 | A | * | 11/1920 | Shaw | 297/354.11 |
| 2,304,349 | A | * | 12/1942 | Fox | 297/230.14 |
| 2,434,007 | A | * | 1/1948 | O'Dea | 297/230.14 |
| 2,553,385 | A | * | 5/1951 | Ruth | 297/399 |
| 2,638,152 | A | * | 5/1953 | Pulsifer | 297/400 |
| 2,765,840 | A | * | 10/1956 | Robert et al. | 297/403 |
| 2,827,110 | A | * | 3/1958 | Rising | 297/399 |
| 2,871,928 | A | * | 2/1959 | Swenson | 297/411.23 |
| 3,764,180 | A | * | 10/1973 | Mulholland | 297/400 |
| 3,885,831 | A | * | 5/1975 | Rasmussen | 297/410 |
| 4,822,033 | A | | 4/1989 | Kohus et al. | |
| 5,054,853 | A | * | 10/1991 | Gillies et al. | 297/250.1 |
| 5,328,244 | A | * | 7/1994 | Ishihara et al. | 297/391 |
| 5,829,832 | A | * | 11/1998 | Molee et al. | 297/397 |
| 5,897,167 | A | * | 4/1999 | Keith | 297/397 |
| 5,904,406 | A | * | 5/1999 | Stewart | 297/397 |
| 6,250,716 | B1 | * | 6/2001 | Clough | 297/408 |
| 6,464,294 | B1 | | 10/2002 | Kain | |
| 6,811,223 | B2 | * | 11/2004 | Ito | 297/408 |
| 7,080,886 | B2 | * | 7/2006 | Bauer | 297/409 |
| 7,204,557 | B1 | * | 4/2007 | Burton | 297/397 |
| 2006/0128485 | A1 | | 6/2006 | Haut | |

* cited by examiner

*Primary Examiner*—Peter R. Brown
(74) *Attorney, Agent, or Firm*—Pillsbury Winthrop Shaw Pittman, LLP

(57) ABSTRACT

A headrest assembly is adapted to be disposed on a child seat. The child seat includes a seat frame. The headrest assembly includes a mounting member connected to the seat frame, and a headrest plate including a mounting seat attached to the mounting member and including a pair of resilient retainers connected respectively to two opposite sides of the mounting member. Each of the retainers has a plurality of positioning portions disposed respectively at different height positions. Each of the sides of the mounting member engages a selected one of the positioning portions of a corresponding one of the retainers.

17 Claims, 6 Drawing Sheets

HEADREST FOR CHILD SEAT

CROSS-REFERENCE TO RELATED APPLICATION

This application claims priority of Chinese Application No. 200720152031.4, filed on Jun. 20, 2007.

BACKGROUND OF THE INVENTION

1. Field of the Invention

This invention relates to a headrest assembly for a seat, and more particularly to a headrest assembly for a child seat, in which a headrest plate is adjustable in height and inclination angle.

2. Description of the Related Art

A conventional child swing typically includes a support frame, and a seat disposed pivotally on the support frame. When a child sits on the seat of such a child swing disclosed in, for example, U.S. Pat. No. 4,822,033 and US Patent Application Publication No. 2006/0128485, the head of the child rests on a backrest of the seat, thereby imparting a feeling of discomfort to the child.

U.S. Pat. No. 6,464,294 discloses a child car safety seat including a height-adjustable headrest that is movable upwardly and downwardly relative to a seat back. However, since the inclination angle of the height-adjustable headrest is not adjustable, the headrest is not suitable for a child seat.

SUMMARY OF THE INVENTION

According to an aspect of this invention, there is provided a headrest assembly adapted to be disposed on a seat frame of a child seat. The headrest assembly comprises:

a mounting member adapted to be connected to the seat frame; and a headrest plate including a mounting seat attached to the mounting member and including a pair of resilient retainers connected respectively to two opposite sides of the mounting member, each of the retainers having a plurality of positioning portions disposed respectively at different height positions, each of the sides of the mounting member engaging a selected one of the positioning portions of a corresponding one of the retainers.

According to another aspect of this invention, there is provided a headrest assembly adapted to be disposed on a seat frame of a child seat. The headrest assembly comprises:

a mounting member adapted to be connected to the seat frame and including a retaining hook adapted to be hung rotatably on the seat frame; and a headrest plate attached to the mounting member.

According to still another aspect of this invention, there is provided a child seat comprising:

a seat frame;

a headrest assembly including a mounting member connected to the seat frame; and a headrest plate including a mounting seat attached to the mounting member, the mounting seat defining a plurality of height positions so as to allow the mounting member to slide on the mounting seat to a selected one of the height positions.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
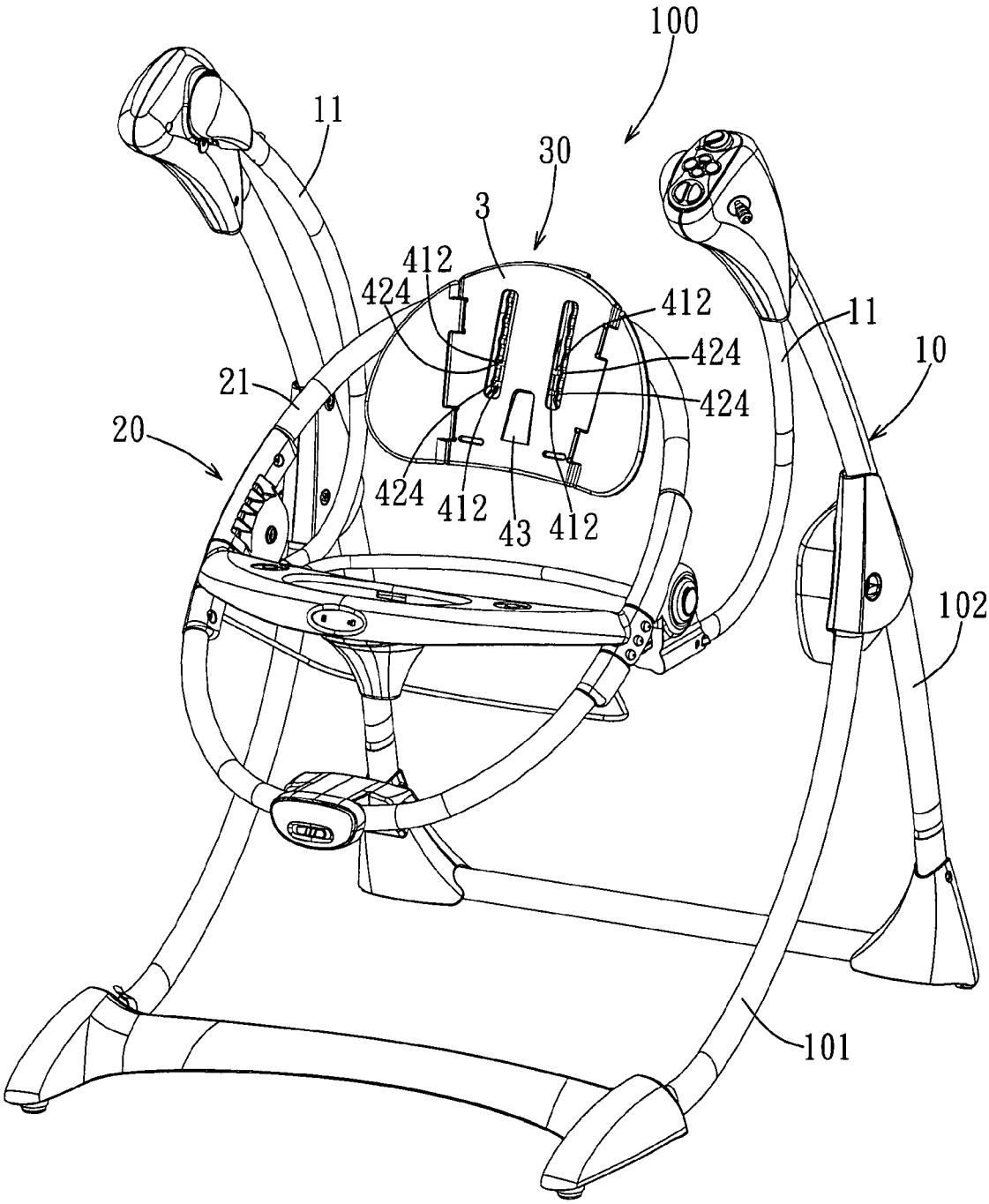
FIG. 1 is a front perspective view of a child swing including the first preferred embodiment of a headrest assembly for a child seat according to this invention.

Before the present invention is described in greater detail in connection with the preferred embodiments, it should be noted that similar elements and structures are designated by like reference numerals throughout the entire disclosure.

Referring to FIG. 1, the first preferred embodiment of a headrest assembly 30 is disposed on a child seat 20 of a child swing 100. The child swing 100 includes a swing frame 10 consisting of front and rear legs 101, 102, and a pair of swing arms 11. The child seat 20 is disposed between and connected pivotally to the swing arms 11, which have upper ends connected pivotally to the swing frame 10. The headrest assembly 30 is disposed on a top end of the child seat 20.

Figure 2:
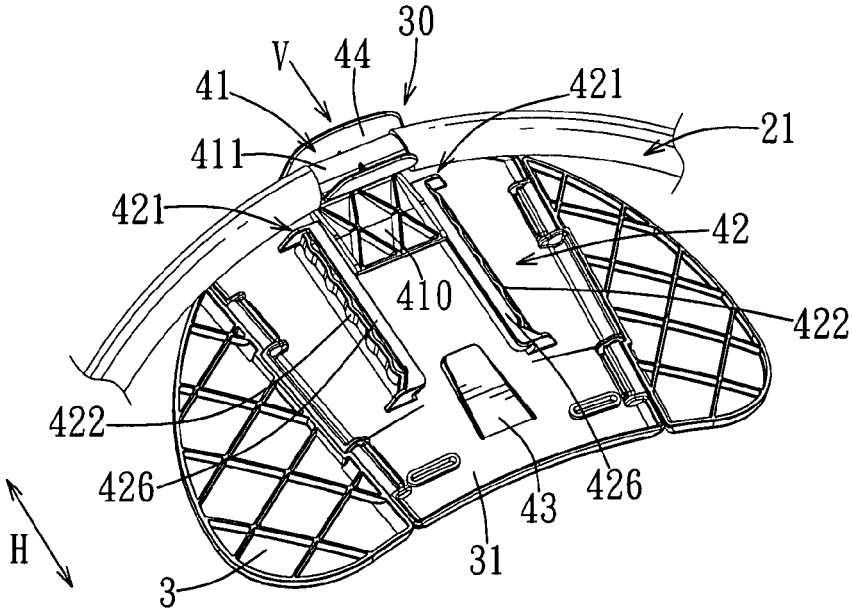
FIG. 2 is a fragmentary assembled rear perspective view of the first preferred embodiment and a seat frame of the child seat when a headrest plate is disposed in a lower limit position.
Figure 3:
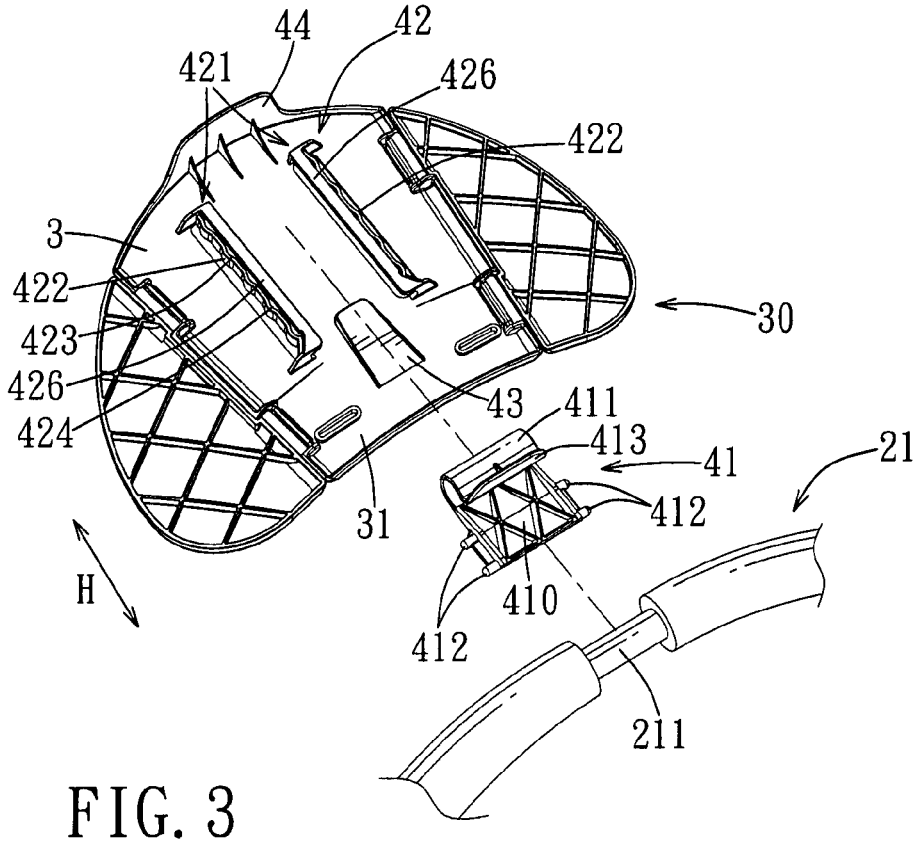
FIG. 3 is a fragmentary exploded rear perspective view of the first preferred embodiment and the seat frame.

With further reference to FIGS. 2 and 3, the child seat 20 includes an elliptical seat frame 21 in this embodiment. The headrest assembly 30 is disposed on a top end of the seat frame 21, and includes a headrest plate 3 and a mounting member 41 connected to a back surface 31 of the headrest plate 3 and hung on the seat frame 21.

The mounting member 41 has a top end formed with a generally C-shaped retaining hook 411 hung rotatably on a tube portion 211 of the seat frame 21. The mounting member 41 further has a rectangular plate body 410 extending from an end of the retaining hook 411 and formed with two pairs of projections 412 disposed respectively on two opposite sides thereof, and a push portion 413 extending from the other end of the retaining hook 411 in a direction perpendicular to the plate body 410. The plate body 410 may be of any other suitable shape. The headrest plate 3 includes a mounting seat 42 disposed on a back surface thereof. The mounting seat 42 includes a pair of integral support frames 421 each extending along a height direction (H) of the headrest plate 3 and having a U-shaped cross-section, and a pair of retainers 422 each hung between upper and lower ends of the corresponding support frame 421. In this embodiment, the retainers 422 are in the form of plates, and are made of a plastic material, and are formed respectively and integrally with the support frames 421. The retainers 422 are corrugated, and have inner side surfaces 423 confronting each other. Each of the inner side surfaces 423 defines a plurality of recesses 424 disposed respectively at different height positions and constituting respectively a plurality of positioning portions. The plate body 410 of the mounting member 41 is inserted into a space between the support frames 421. Each of the projections 412 engages a selected one of the recesses 424 in the corresponding retainer 422 to position the headrest plate 3 relative to the mounting member 41.

To prevent removal of the headrest plate 3 from the mounting member 41 during height adjustment of the headrest plate 3, each of the support frames 421 has an outer side plate 426 parallel to the back surface 31 of the headrest plate 3, and the headrest plate 3 includes an inclined resilient finger 43 extending upwardly and rearwardly therefrom at a position below the retainers 422. The mounting member 41 is confined among the retainers 422 and the resilient finger 43.

Figure 4:
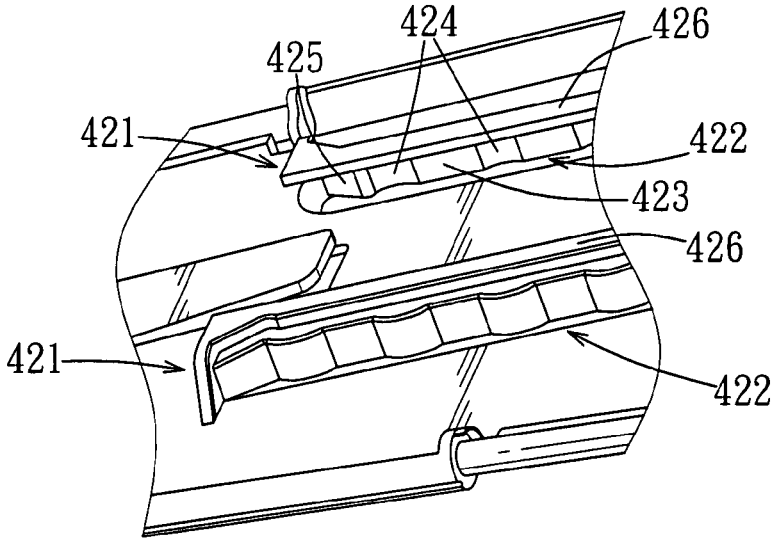
FIG. 4 is a fragmentary perspective view of a mounting seat of the headrest plate of the first preferred embodiment.

Each of the retainers 422 has a lower end formed with an inclined surface 425 (see FIG. 4) that extends downwardly and outwardly for guiding movement of the plate body 410 into the space between the retainers 422.

When it is desired to mount the headrest assembly 30 to the seat frame 21, the mounting member 41 is first inserted into the space between the retainers 422 to engage the projections 412 with selected ones of the recesses 424. Next, the retaining hook 411 of the mounting member 41 is hung on the tube portion 211 of the seat frame 21.

The headrest plate 3 has a top end formed with a flange 44 extending rearwardly therefrom and allowing for manual operation by the user.

When it is desired to lower the headrest plate 3 relative to the seat frame 21, the flange 44 of the headrest plate 3 is pressed downwardly in a direction shown by the arrow (V) in FIG. 2. Hence, each of the retainers 422 slides downwardly on the corresponding pair of the projections 412, which is made possible by the resilience of the retainers 422. As a result, the projections 412 at each side of the mounting member 41 can be moved into the uppermost two recesses 424 in the retainers 422, respectively, to thereby dispose the headrest plate 3 in a lower limit position shown in FIG. 2.

Figure 5:
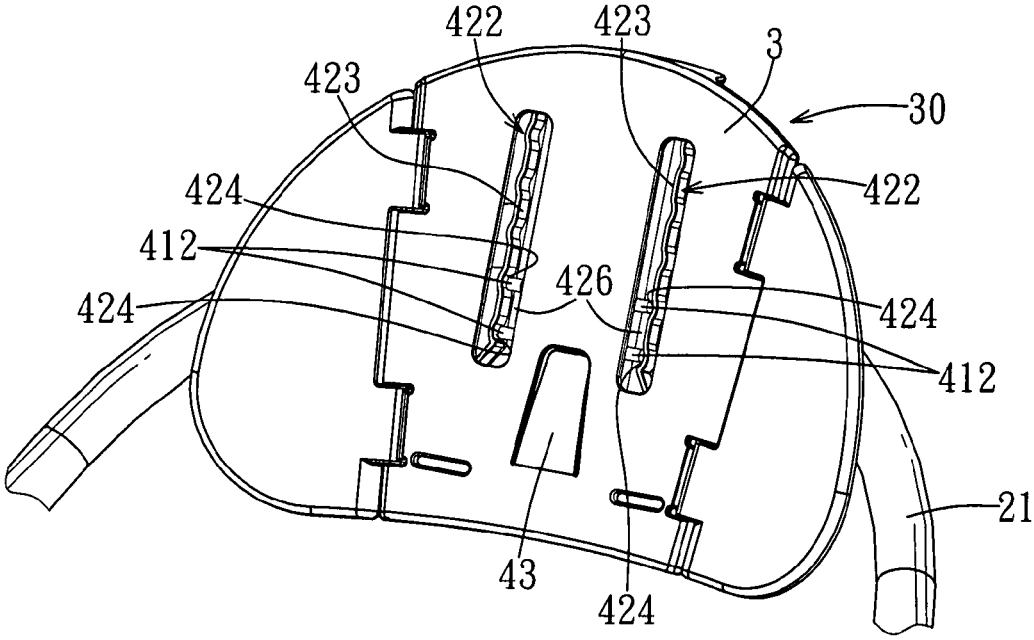
FIG. 5 is a fragmentary assembled front perspective view of the first preferred embodiment and the seat frame when the headrest plate is disposed in an upper limit position.
Figure 6:
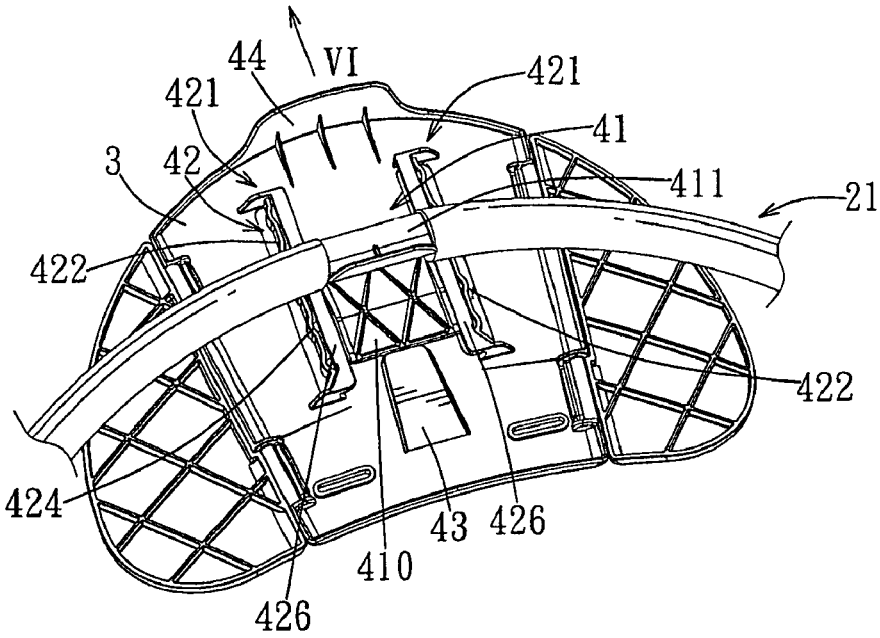
FIG. 6 is a fragmentary assembled rear perspective view of the first preferred embodiment and the seat frame when the headrest plate is disposed in the upper limit position.

With further reference to FIGS. 5 and 6, when it is desired to raise the headrest plate 3 relative to the seat frame 21, the flange 44 of the headrest plate 3 is pulled upwardly in a direction shown by the arrow (VI) in FIG. 6. Hence, each of the retainers 422 slides upwardly on the corresponding pair of the projections 412. As a result, the projections 412 at each side of the mounting member 41 can be moved into the lowermost two recesses 424 in the retainers 422, respectively, to thereby dispose the headrest plate 3 in an upper limit position shown in FIGS. 5 and 6. In the upper limit position, a lower end of the mounting member 41 abuts against a top end of the resilient finger 43. By adjusting the height of the headrest plate 3 in the above manner, the child seat 20 is suitable for children of different heights.

Figure 7:
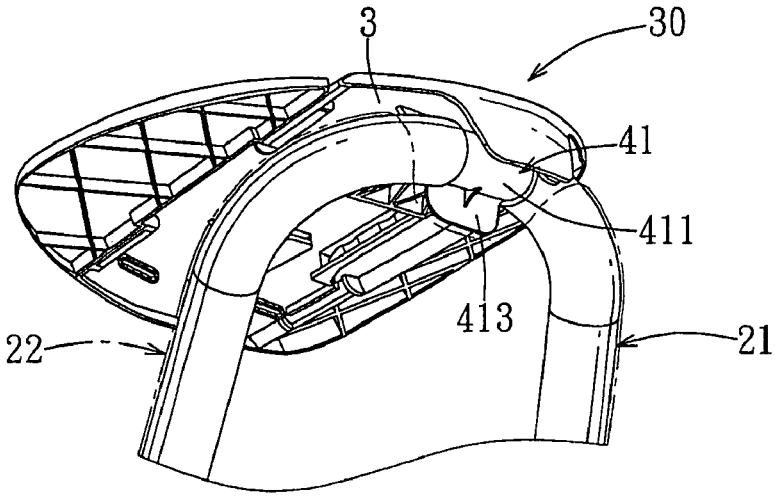
FIGS. 7 and 8 are fragmentary assembled rear perspective views of the first preferred embodiment and the seat frame, illustrating different angles of the headrest plate relative to a tube portion of the seat frame.
Figure 8:
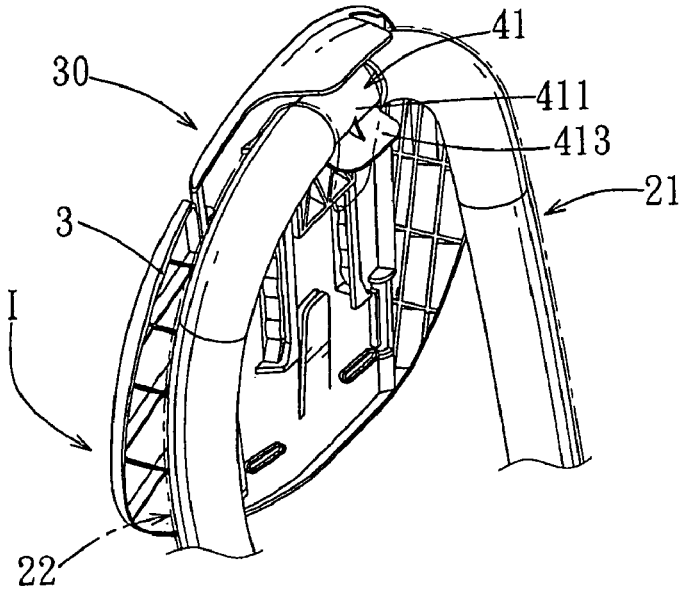

With further reference to FIG. 7, a fabric member 22 is sleeved on the seat frame 21 to form a soft backrest as long as the mounting member 41 can be mounted to the seat frame 21 in the manner described above. When the head of a user rests on the headrest plate 3, the lower end of the headrest plate 3 is pivoted automatically in a counterclockwise direction (I) to abut against the fabric member 22 thereby providing a satisfactory feeling of comfort to the user. During use of the child swing 100 (i.e., the seat frame 21 is swung), the inclination angle of the headrest plate 3 relative to the seat frame 21 can be changed according to the orientation of the head of the user, as shown in FIGS. 7 and 8. When it is desired to move the headrest assembly 30 from the seat frame 21 onto other type of child seat of juvenile product (e.g., a child car safety seat), a force is applied to the push portion 413 of the mounting member 41 to remove the headrest assembly 30 from the tubular tube portion 211 of the seat frame 21.

Figure 9:
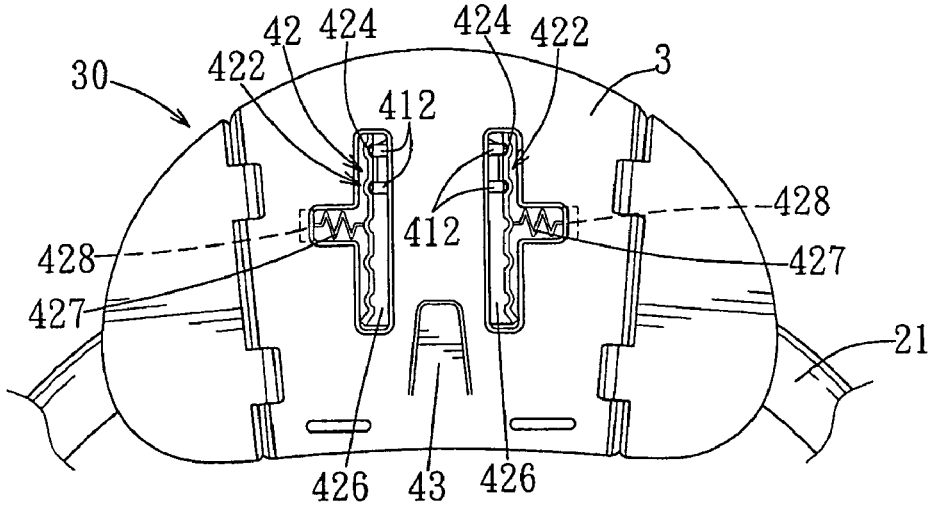
FIG. 9 is a fragmentary assembled front perspective view of the second preferred embodiment of a headrest assembly for a child seat according to this invention and a seat frame of the child seat.

FIG. 9 shows the second preferred embodiment of a headrest assembly 30 according to this invention, which is similar in construction to the first preferred embodiment except that the mounting seat 42 further includes a pair of resilient members 427. Each of the resilient members 427 is configured as a bellows-type reed spring, is made of a plastic material, and has an outer end abutting against a stop projection portion 428 of the headrest plate 3, and an inner end abutting against the corresponding retainer 422. As such, the retainers 422 are biased toward each other by the resilient members 427. Alternatively, the resilient members 427 may be configured as a compression spring.

Figure 10:
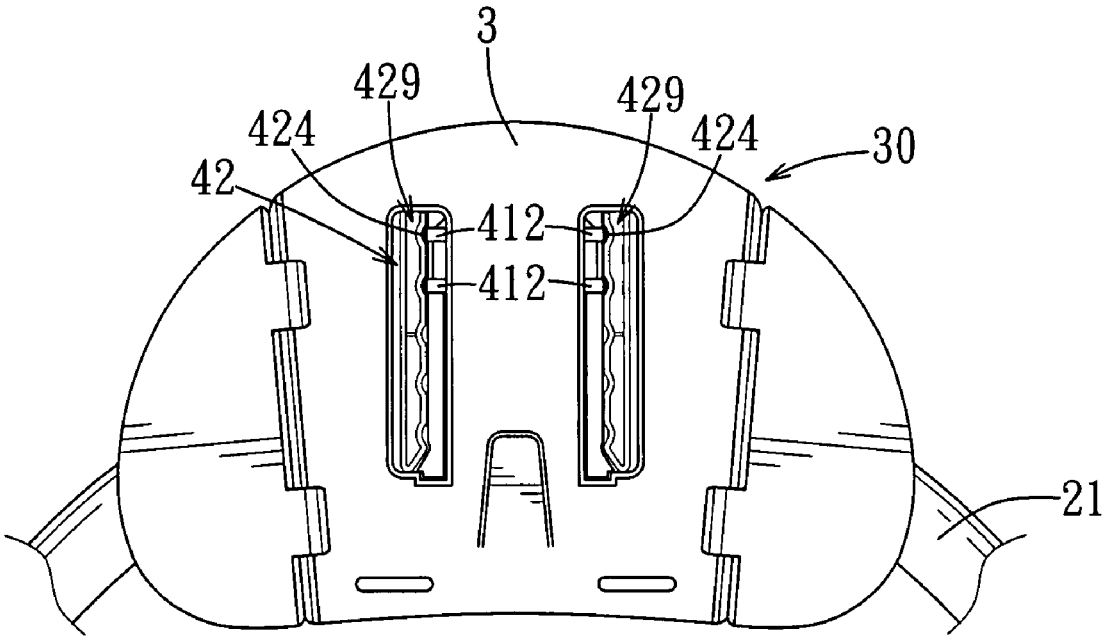
FIG. 10 is a fragmentary assembled front perspective view of the third preferred embodiment of a headrest assembly for a child seat according to this invention and a seat frame of the child seat.

FIG. 10 shows the third preferred embodiment of a headrest assembly 30 according to this invention, which is similar in construction to the first preferred embodiment except that each of the retainers 429 is generally H-shaped. The H-shaped structure of the retainers 429 is able to not only increase the return force created therefrom but also reduce the deformation thereof.

Since the headrest assembly of this invention is adjustable in height and inclination angle, it can be applied to various types of child seats. That is, the applicable range of the headrest assembly of this invention is increased.

With this invention thus explained, it is apparent that numerous modifications and variations can be made without departing from the scope and spirit of this invention. It is therefore intended that this invention be limited only as indicated by the appended claims.

We claim:

1. A headrest assembly adapted to be disposed on a seat frame of a child seat, comprising:

a mounting member adapted to be connected to the seat frame; and a headrest plate including a mounting seat attached to said mounting member and including a pair of resilient retainers connected respectively to two opposite sides of said mounting member, each of said retainers having a plurality of positioning portions disposed respectively at different height positions, each of said sides of said mounting member engaging a selected one of said positioning portions of a corresponding one of said retainers.

2. The headrest assembly as claimed in claim 1, wherein said mounting member includes a plate body and a retaining hook disposed on said plate body and adapted to be connected to said seat frame.

3. The headrest assembly as claimed in claim 2, wherein said retaining hook is C-shaped, and is adapted to be hung rotatably on the seat frame.

4. The headrest assembly as claimed in claim 2, wherein said headrest plate has a back surface, said mounting seat being disposed on said back surface of said headrest plate and including a pair of support frames each extending along a height direction of said headrest plate, each of said retainers being connected between upper and lower ends of a corresponding one of said support frames.

5. The headrest assembly as claimed in claim 4, wherein said plate body of said mounting member is inserted into a space between said support frames, and includes two projections disposed respectively on two opposite sides thereof and engaging respectively said selected ones of said positioning portions of said retainers.

6. The headrest assembly as claimed in claim 5, wherein each of said retainers is formed with an inclined surface that is disposed at a lower end thereof and that extends downwardly and outwardly for guiding movement of said plate body into said space between said retainers.

7. The headrest assembly as claimed in claim 2, wherein said headrest plate has a top end formed with a flange extending rearwardly therefrom and allowing for manual operation.

8. The headrest assembly as claimed in claim 1, wherein said retainers are corrugated, and have inner side surfaces confronting each other and defining a plurality of recesses constituting respectively said positioning portions.

9. The headrest assembly as claimed in claim 1, wherein said headrest plate has a top end formed with a flange extending rearwardly therefrom and allowing for manual operation.

10. The headrest assembly as claimed in claim 1, wherein said headrest plate further includes a resilient finger extending upwardly and rearwardly therefrom at a position below said retainers so as to confine said mounting member among said retainers and said resilient finger.

11. The headrest assembly as claimed in claim 1, wherein said mounting member includes a retaining hook hung removably on said seat frame.

12. The headrest assembly as claimed in claim 1, wherein said mounting seat includes a pair of resilient members for biasing said retainers toward each other.

13. The headrest assembly as claimed in claim 1, wherein each of said retainers is generally H-shaped.

14. A child seat comprising:

a tubular seat frame having a diameter-reduced tube portion;

a headrest assembly including a mounting member, said mounting member including a C-shaped retaining hook rotatably connected on said diameter-reduced tube portion of said tubular seat frame to allow rotation of the headrest assembly to different positions while in use; and a headrest plate including a mounting seat attached to said mounting member, said mounting seat defining a plurality of height positions so as to allow said mounting member to slide on said mounting seat to a selected one of the height positions.

15. The child seat as claimed in claim 14, wherein said mounting seat includes a pair of resilient retainers connected respectively to two opposite sides of said mounting member, each of said retainers having a plurality of positioning portions disposed respectively at said height positions, each of said sides of said mounting member engaging a selected one of said positioning portions of a corresponding one of said retainers.

16. The child seat as claimed in claim 14, wherein said headrest assembly is connected removably to said tubular seat frame.

17. The child seat as claimed in claim 14, wherein said headrest assembly is rotatable relative to said tubular seat frame to change an inclination angle thereof relative to said tubular seat frame.

* * * * *